US007041349B2

(12) United States Patent
Tanaka et al.

(10) Patent No.: US 7,041,349 B2
(45) Date of Patent: May 9, 2006

(54) THERMAL TRANSFER IMAGE RECORDING COMPOSITE SHEET

(75) Inventors: Yoshimasa Tanaka, Tokyo (JP); Yoshio Mizuhara, Tokyo (JP); Shigeru Nagashima, Tokyo (JP); Yoshihiro Shimizu, Yokohama (JP); Hideaki Shinohara, Nishitokyo (JP)

(73) Assignee: OJI Paper Co., Ltd., Tokyo (JP)

( * ) Notice: Subject to any disclaimer, the term of this patent is extended or adjusted under 35 U.S.C. 154(b) by 27 days.

(21) Appl. No.: 10/455,500

(22) Filed: Jun. 6, 2003

(65) Prior Publication Data

US 2003/0228430 A1 Dec. 11, 2003

(30) Foreign Application Priority Data

Jun. 10, 2002 (JP) ..... 2002-168861
Aug. 7, 2002 (JP) ..... 2002-230030

(51) Int. Cl.
*B41M 5/40* (2006.01)

(52) U.S. Cl. ..... 428/32.63; 428/32.7; 428/32.78; 428/32.81; 428/32.87; 428/40.2; 428/41.8; 428/206; 428/213; 428/323; 428/423.1; 428/474.4; 428/480; 428/500; 428/32.39; 428/32.5; 264/288.4; 264/288.8

(58) Field of Classification Search ..... 428/32.63, 428/32.7, 32.78, 32.81, 32.87, 40.2, 41.8, 428/206, 213, 323, 480, 500, 914, 423.1, 428/474.4, 32.39, 32.5; 264/288.4
See application file for complete search history.

(56) References Cited

U.S. PATENT DOCUMENTS

| | | | | |
|---|---|---|---|---|
| 5,721,086 | A * | 2/1998 | Emslander et al. | 430/126 |
| 5,882,754 | A * | 3/1999 | Kuroyama et al. | 428/32.22 |
| 6,200,670 | B1 * | 3/2001 | Hosoi et al. | 428/32.37 |
| 6,461,422 | B1 * | 10/2002 | Yang et al. | 106/287.35 |
| 6,482,490 | B1 * | 11/2002 | Hanahara et al. | 428/40.1 |
| 6,652,929 | B1 * | 11/2003 | Moriya et al. | 428/32.12 |
| 6,699,817 | B1 * | 3/2004 | Mizuhara et al. | 503/227 |
| 2003/0003276 | A1 * | 1/2003 | Mizuhara | 428/195 |
| 2003/0047638 | A1 * | 3/2003 | Shinohara et al. | 242/532.3 |
| 2004/0023800 | A1 * | 2/2004 | Horii et al. | 503/227 |

FOREIGN PATENT DOCUMENTS

| | | | |
|---|---|---|---|
| EP | 0 807 533 A2 | | 11/1997 |
| EP | 1 238 818 A1 | | 9/2002 |
| JP | 2-188295 | | 7/1990 |
| JP | 5-147364 | | 6/1993 |
| JP | 9-254559 | | 9/1997 |
| JP | A-9-300832 | | 11/1997 |
| JP | 10-86540 | | 4/1998 |
| JP | 10-250240 | * | 9/1998 |
| JP | 11-34517 | | 2/1999 |
| JP | 2000-43433 | | 2/2000 |
| JP | 2000-177257 | | 6/2000 |
| JP | 2001-246865 | * | 9/2001 |
| JP | 2001-260548 | | 9/2001 |

OTHER PUBLICATIONS

A copy of Japanese Patent Office Action for corresponding Japanese patent application No. 2002-168861 dated Jun. 28, 2005.

* cited by examiner

*Primary Examiner*—B. Shewareged
(74) *Attorney, Agent, or Firm*—Armstrong, Kratz, Quintos, Hanson & Brooks, LLP

(57) ABSTRACT

A thermal transfer image recording composite sheet has a lamination structure: (2) image receiving sheet section (including image receiving layer (D), image recording sheet substrate (C) and adhesive layer (E)) and (1) release sheet section (including release layer (B) and release sheet substrate (A)), and exhibits, as a whole, a compressive modulus of 50 MPa or less, wherein, the substrate (C) is constituted from (a) an upper oriented porous polyester film layer bonded to the image receiving layer (D) and (b) a lower oriented porous polymer film layer, the polymer of which is different from polyester of the layer (a), laminated on the upper film layer (a) and bonded to the adhesive layer (E), or the adhesive layer (E) comprises, together with an adhesive agent, a plurality of hollow particles each formed from a hollow core portion and a shell portion and has an average particle size of 0.3 to 30 μm, in which recording sheet the image receiving section (2) can be separated from the release sheet section (1) and adhered to a desired article.

13 Claims, No Drawings

THERMAL TRANSFER IMAGE RECORDING COMPOSITE SHEET

BACKGROUND OF THE INVENTION

1) Field of the Invention

The present invention relates to a thermal transfer image recording composite sheet, which will be referred to "image recording composite sheet" hereinafter, more particularly, the present invention relates to an image recording composite sheet in which an image recording sheet section is separably adhered to a release sheet section, and after images are thermal transfer-recorded on the image recording sheet section, the image recording sheet section can be separated from the release sheet section and adhered to a desired article, and which image recording composite sheet has a high resistance to roughening and denting of an image receiving layer due to a thermal shrinkage of a paper sheet substrate, on which the image receiving layer is formed, when the ink image recording sheet is heated imagewise by a thermal head of a thermal transfer printer, is capable of recording thereon ink images having a clarity and resolving degree compatible with those of silver salt photographic images, and is substantially free from denting under sheet-conveying nip roller pressure.

2) Description of the Related Art

A conventional thermal transfer image recording sheet is used to record images thereon by bringing a surface of an ink layer of an ink sheet into contact with a surface of an image receiving layer, comprising a dye-absorbing resin, of an image recording sheet, and thermally transferring portions of the ink or dye in the ink layer imagewise onto the image receiving layer surface by heating the ink layer imagewise with heat supplied from an imagewise heating means such as a thermal head.

For the recording, an ink ribbon having 3 coloring ink layers, namely a yellow-coloring ink layer, a magenta-coloring ink layer and a cyan-coloring ink layers or 4 coloring ink layers, namely a black-coloring ink layer in addition to the above-mentioned 3 color ink layers arranged repeatedly on a substrate film is used, and full-color ink images are formed by thermally transferring the yellow-, magenta-, cyan- and optionally black-coloring inks successively imagewise onto the ink image recording sheet and superposing the transferred coloring ink images one upon another.

The image recording sheet includes a thermal transfer image recording composite sheet comprising a release sheet section having a release layer formed on a sheet substrate for this section and an image recording sheet section having an adhesive layer formed on a surface of a sheet substrate for this section and separably adhered to the release layer of the release sheet section and an image receiving layer formed on an opposite surface of the sheet substrate for the image recording sheet section. In this type of the image recording composite sheet, after desired images are thermally recorded on the image receiving layer of the image recording sheet section, the image recorded sheet section can be released from the release layer of the release sheet section and adhered on a desired article. This thermal transfer recording composite sheet is usable as an adherable label.

The thermal transfer recording composite sheet must enable the ink images thermal transfer recorded thereon to have a high color density and a high uniformity and to be free from wrinkle marks transferred from the ink sheet or the ribbon. Also, the recording composite sheet needs to have a good moving property, through the printer.

Namely, the recording composite sheets must be smoothly supplied one by one into the printer, be superposed on the ink sheet, be separated from the ink sheet without fuse-adhering to the ink sheet, and be delivered from the printer without blocking the delivery of the recorded sheet from the printer. Further, after printing, the image-bearing recording sheet section can be easily and precisely released from the release sheet section. Furthermore, the released recording sheet section must have an appropriate compression modulus and hand.

Currently, with development of the thermal transfer printers, popularization of digital cameras, and improvements in the high degree of digital image treatment using computers, the quality of the resultant images is significantly enhanced, and thus the application of the ink image thermal transfer recording system in trade practice is expanded. For example, the ink image thermal transfer recording system is utilized in outputs of printing and proofreading of designs, outputs of images of endoscopies and CT scannings for medical treatments, and outputs of photographs of persons faces and calenders, for amusement, and of ID cards and credit cards for certification photographs. Also, with an improvement in the temperature-controlling technique for the thermal heads, an increase in recording speed of the ink image thermal transfer recording system is strongly required. For example, a printer capable of printing images on a A6 size sheet within a time of 30 seconds or less has appeared on the market. The requirement for an increase in recording speed will be further increased in the future.

Also, with the increase in the recording speed, new problems in gradation in color density of the recorded images, in precision and accuracy of the recorded images and in prevention of shearing in the ink images superposed one upon another occur. To obtain a good gradation in color density of the recorded images, the images in a wide range of the color density must be recorded with a recording energy in a narrow range and, to record images having a high color density with a low energy, the ink image recording sheet must have a high heat-insulating property. Also, to record ink images with high precision and accuracy, a close contact of the ink sheet with the thermal head and with the ink image recording sheet superposed on the ink sheet is necessary and the ink image recording sheet must have a good cushoning property.

In the full color printing procedure, to prevent the shearing in the recorded ink images superposed on each other, the ink image recording sheet is nipped, between spike-provided rolls and rubber rolls, to convey the sheet through the printer. In this case, to precisely convey the sheet at a high speed, the nipping of the sheet must be ensured by increasing the size of the spikes and/or the nipping pressure. This enhanced nipping causes a problem, that a plurality of dents and/or spike marks are formed on the image recording surface of the recording sheet, and thus the commercial value of the recorded sheet decreases, to occur.

In a thermal head type printer system, as a separate-adherable thermal transfer recording sheet capable of recording thereon ink images with a good quality, Japanese Unexamined Patent Publication No. 09-300,832 discloses an image recording sheet section having a foamed resin film layer on a surface of which an image receiving layer is formed, and a non-foamed resin film layer formed between an opposite surface of the foamed resin film layer and an adhesive layer. However, this type of the recording sheet has, as a whole, a high compressive modulus and is disadvantageous in that when the recording operation is carried out at a high recording speed while the recording sheet is conveyed by firmly nipping the recording sheet between spike-provided rolls and rubber rolls under an increased nipping pressure, to prevent shearing in printing, a plurality of undesirable dents and/or spike-marks are formed on the image recording layer surface of the recording sheet section.

In another type of known thermal transfer recording composite sheet, a recording sheet section is constituted from a substrate sheet (support) consisting of an oriented porous polymer film comprising, as a principal component, a polyester or polypropylene resin, an image receiving layer comprising, as a principal component, a dyeable resin and formed on a surface of the substrate sheet directly or through an intermediate layer, and an adhesive layer comprising an adhesive agent and formed on an opposite surface (free from the image receiving layer) of the substrate sheet.

The oriented porous polymer film is advantageous in that the thickness of the film is even, the softness of the film is appropriate, the heat conductivity of the film is lower than that of paper sheet comprising, as a principal component, a cellulose pulp fibers, and thus the recorded images on the image receiving layer have a high and uniform color density.

Generally, the color density of the recorded images can be increased by decreasing the apparent density of the film by, for example, increasing the number of pores and/or the size of the pores, to enhance the heat insulating property of the film. However, the decrease in the apparent density causes the mechanical strength and elastic modulus of the film to decrease and also, the resistance of the film to denting, due to the sheet-conveying rolls, to decrease.

When the image receiving layer is formed from a non-porous film comprising, as a principal polymer component, a polyester, the resultant surface layer exhibits a high heat resistance, a high tensile elastic modulus and enables the resultant recording sheet to exhibit a good hand as a label, and an increased resistance to the denting due to the sheet-conveying rolls. However, this polyester film layer causes a disadvantage in that the uniformity of contact of the film layer with the thermal head-through the ink sheet and the resistance to wrinkle formation on the recorded images are decreased.

Also, when the image receiving layer comprises, as a principal component, a polypropylene, is employed, the uniformity of contact of the film layer with the thermal head through the ink sheet is satisfactory. However, during the thermal transfer recording, the film layer shrinks so as to roughen the film layer surface and a plurality of dents are formed on the film layer due to the sheet conveying nip rolls.

Under the above-mentioned circumstances, as a substrate sheet for the image recording sheet section, an oriented porous polymer film comprising as a principal component, a polyester resin is widely employed.

However, the quality of the resultant conventional separate-adherable thermal transfer recording sheet is unsatisfactory, and must be improved.

Accordingly, there is a strong demand for a new type of thermal transfer image recording composite sheet having an image recording sheet section capable of uniformly contacting with the thermal head through an ink sheet, and thus of recording ink images with high precision and accuracy similar to those of silver-salt photographic images, and having high heat-insulating property, a low thermal shrinkage, and a high resistance to denting due to the sheet-conveying nip rolls.

SUMMARY OF THE INVENTION

An object of the present invention is to provide a thermal transfer image recording composite sheet which has a high recording sensitivity for various thermal transfer printers; a image recording surface of which is substantially not roughened or wrinkled by imagewise heating with a thermal head, and can thus record images with high color density, clarity and uniformity, and exhibits a high resistance to denting (formation of a plurality of dents) due to nipping pressure applied to the image recording surface by sheet-conveying nip rolls of the printers; and of which a image recording sheet section can be released from a release sheet section and adhered to a desired article.

The above-mentioned object can be attained by the thermal transfer image recording composite sheet of the present invention which comprises:

(1) a release sheet section comprising (A) a substrate sheet for the release sheet section (1), and (B) a release layer formed on a surface of the substrate sheet (A) and comprising a release agent; and (2) an image recording sheet section comprising (C) a substrate sheet for the image recording sheet section (2), (D) an image receiving layer formed on a surface of the substrate sheet (C) and comprising a dyeable resin, and (E) an adhesive layer formed on an other surface of the substrate sheet (C) than the surface on which the image receiving layer is formed, comprising an adhesive agent and separably adhered to the release layer (B) of the release sheet section (1), the recording sheet having, as a whole, a compressive modulus of 50 MPa or less, determined in accordance with Japanese Industrial Standard K 7220.

In the thermal transfer image recording composite sheet of the present invention, the substrate sheet (C) for the image recording sheet section (2) preferably comprises (a) an upper oriented porous polyester film layer bonded to the image receiving layer (D) and (b) a lower oriented porous polymer film layer the polymer of which is different from the polyester for the upper oriented porous polyester film layer (a) and which is bonded, on a surface thereof, to the adhesive layer (E), and, on an other surface thereof, to the upper oriented porous polyester film layer (a). In the thermal transfer image recording composite sheet of the present invention, the oriented porous polyester film for the upper polyester film layer (a) preferably has a compressive modulus of 10 to 80 MPa.

In the thermal transfer image recording composite sheet of the present invention, the oriented porous polyester film for the upper polyester film layer (a) is preferably one produced by forming an undrawn film from a mixture comprising a matrix polyester resin and at least one member selected from a particulate resin and a filler each incompatible with the matrix polyester resin; and drawing the undrawn film in at least one direction, to cause the oriented polyester film to be porous.

In the thermal transfer image recording composite sheet of the present invention, the oriented porous polymer film for the lower polymer film layer (b) preferably has a compressive modulus of 45 MPa or less.

In the thermal transfer image recording composite sheet of the present invention, the oriented porous polymer film for the lower polymer film layer (b) preferably comprises at least one member selected from polyolefin, nylon, polyurethanes and polybutadiene resins.

In the thermal transfer image recording composite sheet of the present invention, the oriented porous polymer film for the lower polymer film layer (b) is preferably one prepared by forming an undrawn film from a mixture comprising a matrix polymer different from polyester for the upper polyester film layer (a) and at least one member selected from a particulate resin and a pigment each incompatible with the matrix polymer: and drawing the undrawn film in at least one direction to cause the oriented polymer film to the porous.

In the thermal transfer image recording composite sheet of the present invention, the adhesive layer (E) preferably comprises, in addition to the adhesive agent, a plurality of hollow particles each constituted from a core hollow portion and a shell portion comprising a polymeric material and surrounding and closing the core hollow portion, the hollow particles having an average particle size of 0.3 to 3.0 μm.

In the thermal transfer image recording composite sheet of the present invention, in the adhesive layer (E), the hollow particles may be present in an amount of 0.1 to 2.5% by mass based on the dry solid mass of the adhesive layer (E).

In the thermal transfer image recording composite sheet of the present invention, a ratio ($TH_C/TH_A$) of the thickness $TH_C$ of the substrate sheet (C) of the image recording sheet section (2) to the thickness $TH_A$ of the substrate sheet (A) of the release sheet section (1) is preferably in the range of from 0.35 to 2.5.

In the thermal transfer image recording composite sheet of the present invention, the adhesive layer (E) is preferably present in an amount, by dry solid mass, of 5 to 30 $g/m^2$.

In the thermal transfer image recording composite sheet of the present invention, the hollow particles for the adhesive layer (E) are preferably selected from the group consisting of (i) foamed hollow particles produced by heat-foaming particles comprising a thermoplastic polymer material and a thermal expansion substance mixed into the thermoplastic polymer material; and (ii) microcapsules produced by forming precursor microcaplules each comprising a core portions consisting of a volatile liquid and a shell portion comprising a thermoplastic polymer material and surrounding the core portion by a microcapsule-polymerization method, and evaporating away the volatile liquid from the precursor microcapsules, to form microcapsules each having a hollow core surrounded and closed by a shell.

In the thermal transfer image recording composite sheet of the present invention, the dyeable resin contained in the image receiving layer (D) is preferably dyeable with sublimating dyes.

In the thermal transfer image recording composite sheet of the present invention, the image receiving layer (D) preferably exhibits a Hunter brightness of 80% or more, determined in accordance with JIS P 8123 and a Hunter opacity of 90% or more, determined in accordance with JIS P 8138.

In the thermal transfer image recording composite sheet of the present invention, the upper oriented porous polyester film layer (a) in the substrate sheet (c) for the image recording sheet section (2) preferably exhibits a Hunter brightness of 80% or more determined in accordance with JIS P 8123 and a Hunter opacity of 90% or more, determined in accordance with JIS P 8138.

DESCRIPTION OF THE PREFERRED EMBODIMENTS

The thermal transfer image recording composite sheet of the present invention comprises a release sheet section (1) and an image recording sheet section (2) separably adhered to each other.

The release sheet section (1) comprises a substrate sheet (A) for the release sheet section (1), which will be referred to a release sheet substrate (A) hereinafter, and a release layer (B) formed on the release sheet substrate (A) and comprising a release agent. The image recording sheet section (2) comprises a substrate sheet (C) for the image recording sheet section (2), which will be referred to an image recording sheet substrate (2) hereinafter, an image receiving layer (D) formed on a surface of the image recording sheet substrate (C) and comprising a resin dyeable with a dye, preferably a sublimating dye, and an adhesive layer (E) formed on an surface of the image recording sheet substrate (C) other than the surface on which the image receiving layer (D) is formed, comprising an adhesive agent, and separably adhered to the surface of the release layer (B) of the release sheet section (1).

The image recording composite sheet of the present invention has, as a whole, a compressive modulus of 50 MPa or less, preferably 50 MPa or less but not less than 10 MPa, more preferably 5 to 40 MPa, still more preferably 5 to 30 MPa, determined in accordance with Japanese Industrial Standard (JIS) K 7220.

In an embodiment of the image recording composite sheet of the present invention, the image recording sheet substrate (C) comprises:

(a) an upper oriented porous polyester film layer on which the image receiving layer (D) is formed and bonded thereto, and (b) a lower oriented porous polymer film layer, the polymer of which is different from the polyester for the upper oriented porous polyester film layer (a), on a surface of which, the upper oriented porous polyester film layer (a) is laminated, and an other surface of which is coated with the adhesive layer (E).

The above-mentioned specific two-layered image recording sheet substrate, and the limited compressive modulus, enable the image recording sheet of the present invention to exhibit significantly high resistances to roughening of the image recording surface due to imagewise heating by the thermal head and to denting and spike marks on the image recording surface due to nipping pressure applied to the image recording sheet by sheet-conveying nip rolls, and a excellent sensitivity on dye thermal transfer recording, and the recorded images to exhibit high color density and clarity.

The reasons for the above-mentioned advantages, particularly the high resistance to the denting due to the nipping pressure of the sheet-conveying nip rolls, of the image recording sheet of the present invention is explained as follows.

The image recording sheet section (2) is constituted from the upper oriented porous polyester film layer (a) and the lower oriented porous polymer film layer (b), the polymer of which is different from the polyester of the polyester film layer (a), laminated on each other.

In the laminate, a back surface of the upper polyester film layer (a) is bonded to a front surface of the lower polymer film layer (b), a front surface of the upper oriented porous polyester film layer (a) is coated with the image receiving layer (D) and a back surface of the lower oriented porous polymer film layer (b) is coated with the adhesive layer (E).

When the image recording composite sheet supplied to a thermal transfer printer is conveyed through the printer by using nip rolls, while applying a high nipping pressure to the image recording surface of the image recording sheet, the nipping pressure is absorbed mainly by a combination of the upper oriented porous polyester film layer (a) adjacent to the image receiving layer (D) with the lower oriented porous polymer film layer (b) bonded to the polyester film layer (a), to prevent the roughening of and the concavity formation on the image receiving layer surface by a synergismic effect of the upper polyester film layer (a) and the lower polymer film layer (b). Also, as the upper oriented porous polyester film layer (a) located adjacent to the image receiving layer (D) has a high heat resistance, a high smoothness and a low heat conductivity, and the image recording composite sheet has, as a whole, a low compressive modulus, when a compressive force is applied to the image recording sheet, for example, between a thermal head and a platen roll, the image recording sheet can be appropriately deformed to absorb the compressive energy, and when the compressive force is released, the image recording sheet can immediately return to the original form. Further the specific constitution of the image recording sheet substrate (C) and the limited compressive modulus of the image recording sheet contribute to enhancing the close adhesion of the thermal head to the surface of the image receiving layer (D), and thus to improving the sensitivity of the image receiving layer (D) on the thermal transfer recording, to improve the quality of the recorded images.

The polyester film for the upper oriented porous polyester film layers (a) is preferably formed from at least one member selected from homopolyesters of terephthalic acid with ethylene glycol and copolyesters of terephthalic acid, ethylene glycol and at least one comonomer. The comonomer for the copolyesters is selected from, for example, hydroxycarboxylic acids, for example, p-hydroxybenzoic acid; aromatic dicarboxylic acids, for example, isophthalic acid and naphthalene dicarboxylic acid; alkylene glycols, for example, butylene glycol and tetramethylene glycol and polyalkylene glycols, for example, polyethyleneglycol and polypropyleneglycol.

The polyester film for the upper polyester film layer (a) has a porous (micro-void) structure and thus exhibits excellent cushoning property and heat-insulating property. Preferably, the polyester film for the upper polyester film layer (a) has a compressive modulus in the range of from 10 to 80 MPa, more preferably from 10 to 50 MPa.

If the compressive modulus is less than 10 MPa, the resultant image recording sheet may exhibit an unsatisfactory resistance to the formation of concavities. Also, if the compressive modulus is more than 80 MPa, the image recording surface of the resultant image recording sheet may not closely contact with the thermal head, and thus the quality of the recorded images may not be unsatisfactory. The upper oriented porous polyester film layer (a) preferably has a thickness of 10 to 80 μm, more preferably 20 to 60 μm.

The oriented porous polyester film for the upper polyester film layer (a) is preferably produced by forming an undrawn film from a mixture comprising a matrix polyester resin and at least one member selected from a particulate resin and a filler each incompatible with the matrix polyester resin; and drawing the undrawn film in at least one direction, to cause the oriented polyester film to be porous, and preferably has an apparent density of 0.6 to 1.2 g/cm$^2$.

The incompatible particulate resin is preferably selected from homopolymers and copolymers of olefins, for example, ethylene and propylene, styrene, butadienes and acrylonitrile. Also, the incompatible filler comprises at least one member selected from, for example, calcium carbonate, magnesium oxide, titanium dioxide, magnesium carbonate, aluminum hydroxide, sodium aluminosilicate, clay, mica, talc, barium sulfate and calcium sulfate.

The above-mentioned incompatible resins and fillers may be used alone or in a mixture of two or more thereof.

In the image recording sheet substrate (C), the lower oriented porous polymer (for example, polyolefin) film layer (b) arranged adjacent to the adhesive layer (E) preferably has a compressive modulus of 45 MPa or less, more preferably 30 MPa or less, still more preferably 3 to 10 MPa, and a thickness of 50 to 200 μm, more preferably 60 to 150 μm. Preferably, the lower polymer film layer (b) is formed from at least one polymer different from the polyester for the upper polyester film layer (a). The polymer different from the polyester is preferably selected from polyolefin resins, nylon resins polyurethane resins and polybutadiene resins. The polyolefin resins include, for example, polypropylene resins, and polyethylene resins.

The oriented porous polymer film for the lower polymer film layer (b) may be prepared by forming an undrawn film from a mixture comprising a matrix polymer different from the polyester for the upper polyester film layer (a) and at least one member selected from a particulate resin and a pigment each incompatible with the matrix polymer: and drawing the undrawn film in at least one direction to cause the oriented polymer film to be porous.

The oriented porous polymer film for the lower polymer film layer (b) may be selected from a foamed polymer film produced from a mixture of a thermoplastic resin different from polyester used in the upper film layer (a) with a foaming agent.

The lower oriented porous polymer film layer (b) preferably has an apparent density of 0.2 to 1.0 g/cm$^3$.

In an example of the oriented porous polymer film for the lower film layer (b), an oriented porous film formed from a polyolefin resin, for example, polyethylene and/or polypropylene resins, mixed with inorganic pigment particles, is preferably employed. In this case, an undrawn film is produced from a mixture of a polyolefin resin and inorganic pigment particles, and is biaxially drawn to cause a plurality of fine pores (micro-voids) to be formed in the drawn film. The polyolefin film for the lower film layer (b) may have a single layer structure or a multi-layered structure. In the multi-layered structure, a plurality of oriented porous polymer films are united into a single body of laminate film by a conventional lamination method, for example, a dry lamination method, a wet lamination method or a melt lamination method. There is no limitation to the structure of the multi-layered film, namely, the combination mode of the individual oriented porous polymer films.

In the image recording sheet substrate (C) for the recording composite sheet of the present invention, the lower oriented porous polymer film layer (b) bonded to the adhesive layer (E) preferably has a lower compressive modulus than that of the upper oriented porous polyester film layer (b) on which the image receiving layer (D) is formed. In this case, when a high pressure is applied from the sheet-conveying nip rolls to the recording composite sheet, most of the applied pressure can be absorbed by the lower oriented porous polymer film layer (b) on the adhesive layer (E) and, thus, undesirable deformation of the upper oriented porous polyester film layer (a) and the image receiving layer (D) formed on the polyester film layer (a) can be prevented.

The upper oriented polyester film layer (a) on which the image receiving layer (D) is formed and the lower oriented polymer film layer (b) a lower surface of which is bonded to the adhesive layer (E) are laminated on and bonded to each other by a dry lamination method, a wet lamination method or calendering method.

The recording composite sheet of the present invention preferably has, as a whole, a thickness of 100 to 300 μm, more preferably 150 to 280 μm. If the thickness is less than 100 μm, the resultant recording composite sheet may exhibit insufficient mechanical strength and rigidity and an unsatisfactory resistance to curling of the sheet when thermal transfer recorded. If the thickness is more than 300 μm, an upper limit of the number of the sheets capable being contained in a printer may become low, or an increase in the capacity of the sheet container may become necessary, and thus it may become difficult to make the printer compact.

In the above-mentioned embodiment of the recording composite sheet of the present invention, an image receiving layer (D) having excellent brightness (whiteness) and opacity can be realized, while an upper oriented porous polyester film (a) having relatively low brightness and opacity is employed as a substrate for the image receiving layer (D). As an oriented polymer film for the lower film layer (b), a polyolefin resin film, for example, a polyethylene or polypropylene film, is preferably used. In this case, a resinous mixture comprising, as principal components, a polyolefin resin and an inorganic pigment is formed into an undrawn film, and the film is biaxially drawn to provide an oriented porous polyolefin film having a plurality of microvoids. Preferably, a synthetic paper sheet formed from two or more oriented porous polyolefin films laminated on each other into a composite film is used for the lower polymer film layer (b). The ratio in thickness of the lower oriented polymer film layer (b) to the upper oriented polyester film layer (c) is preferably in the range of from 1 to 8, more preferably from 2 to 5. If the thickness ratio ((b)/(a)) is less than 1, the resultant image receiving layer may exhibit an insufficient brightness and opacity. If the thickness ratio ((b)/(a)) is more than 8, the thickness of the upper oriented porous polyester film layer (a) may be too small and the resultant recording sheet may exhibit an insufficient resistance to denting.

In the recording composite sheet of the present invention, the image receiving layer (D) in the image recording sheet section (2) preferably has a Hunter brightness of 80% or more, more preferably 83% or more, determined in accordance with JIS P 8123, and a Hunter opacity of 90% or more, more preferably 94% or more. If the Hunter brightness is less than 80%, the recorded images sharpness may exhibit an insufficient contrast or and may look dark and dull. Also, if the Hunter opacity is less than 90%, when the printed image recording sheet section is adhered to an article, images having been formed on the article may be observed through the adhered image recording sheet section, and thus the images on the image recording section may appear spoiled by the images on the article.

In the recording composite sheet of the present invention, the upper oriented porous polyester film layer (a) preferably exhibits a Hunter brightness of 80% or more, more preferably 85%, determined in accordance with JIS P 8123, and a Hunter opacity of 90% or more, more preferably 95% or more, determined in accordance with JIS P 8138. If the brightness is less than 80%, it may be difficult to record images with good contrast and thus the recorded images may look dark and dull. If the Hunter opacity is less than 90%, when a printed image recording sheet section is adhered to an article, images having been formed on the article may be observed through the adhered image recording sheet section, and thus the images on the image receiving layer (D) may appear spoiled by the images on the article.

The adhesive agent for the adhesive layer (E) preferably comprises at least one member selected from conventional adhesive resins, for example, acrylic resins, synthetic rubbers, natural rubber and silicone resins.

The adhesive rubbers include natural rubber, isoprene rubber, styrene-butadiene block copolymers, styrene-isoprene-styrene block copolymers, polyisobutylene, butyl rubber, chloroprene rubber, and nitrile rubbers.

Among the adhesive resins for the adhesive layer (E), the acrylic resins are very preferably employed. The acrylic resins usable as the adhesive agent include resins prepared from, as principal monomers, at least one member selected from 2-ethylhexyl acrylate, butyl acrylate, and ethyl acrylate and, as comonomers, at least one member selected from other (meth)acrylate esters different from the above-mentioned acrylate ester for the principal monomers and having at least one group selected from non-functional groups or functional groups and optionally at least one other ethylenically unsaturated comonomer than those mentioned above.

The adhesive layer optionally comprises, in addition to the adhesive agent, at least one additive selected from tackifiers, for example, rosin, modified rosins, derivatives of rosin and modified rosins, polyterpene resins, aliphatic hydrocarbon resins, cyclopentadiene resins, aromatic petroleum resins, phenol resins, and coumarone-indene resins; cross-linking agents, for example, isocyanate compounds, epoxy compounds and metal chelete compounds, anti-aging agents, stabilizers, softening agents, for example, oils, fillers, pigments and coloring materials. The additives may be employed alone or in a mixture of two or more thereof.

The contents of the tackifiers and the cross-linking agents in the adhesive layer may be appropriately established in response to the types and content ratios of the adhesive resins, the tackifiers and the cross-linking agents and the combinations thereof.

The peel force and creep property of the adhesive layer (E) can be adequately adjusted by controlling the types and contents of the adhesive agents, tackifiers and the cross-linking agents.

For example, the tackifiers are preferably contained in a content of 5 to 50% by mass, more preferably 5 to 30% by mass and the cross-linking agents are preferably contained in a content of 0.2 to 5% by mass, more preferably 0.5 to 3% by mass, based on the dry solid content of the adhesive agent.

The adhesive polymers for the adhesive agent preferably have a certain high molecular weight (more preferably 250,000 or more, still more preferably 300,000 to 600,000) and the functional groups in individual adhesive polymer molecules are located close to each other. The functional groups are cross-linked with each other through the cross-linking compound. The cross-linking compound preferably has a relatively low molecular weight, and is employed in a relatively small amount.

The adhesive layer (E) is formed by coating a coating liquid containing the adhesive agent and the additives on a back surface of the image recording sheet substrate (C) by using a coater, for example, a bar coater, a gravure coater, a comma coater, a blade coater, an air knife coater, a die coater, a curtain coater or a lip coater and drying the coated coating liquid layer. Alternatively, the adhesive layer (E) is formed by coating the above-mentioned coating liquid on a front surface of a release layer (B) of a release sheet section (1) and drying the coated coating liquid layer, and then adhering the adhesive layer to the back surface of the image recording sheet substrate (C) on a front surface of which an image receiving layer having been coated. Further alternatively, an image receiving layer (D) is formed on a front surface of an image recording sheet substrate (C), an adhesive layer (E) is formed on a back surface of the image recording sheet substrate (C) to form an image recording sheet section (2), and then the adhesive layer (E) of the image recording sheet section (2) is adhered to a release layer (B) of the release sheet section (1).

The adhesive layer (E) is preferably formed in a dry solid amount of 5 to 30/m$^2$, more preferably 10 to 20 g/m$^2$. If the adhesive layer (E) is formed in an amount less than 10 g/m$^2$, the resultant adhesive layer (E) may exhibit an insufficient adhesive strength. Also, if the amount of the adhesive layer (E) is more than 30 g $m^2$, the adhesive effect of the resultant adhesive layer (E) may be saturated and, thus, from this point of view, an amount of the adhesive layer (E) larger than 30 g/$m^2$ may be unnecessary.

A peel strength of the adhesive layer (E) from the release layer (B) is preferably 390 mN/25 mm or more. If the peel strength is less than 390 mN/25 mm, a problem such that the adhesive layer (E) is partially separated from the release layer (B) may occur. However, the peel strength between the adhesive layer (E) and the release layer (B) is preferably 785 mN/25 mm or less. If the peel strength is more than 785 mN/25 mm, the resultant image recording sheet (2) section may be difficult to separate from the resultant release sheet section (1).

In the image recording sheet substrate (C) of the image recording composite sheet of the present invention, the lower oriented porous polymer film layer (b), which is located adjacent to the adhesive layer (E), preferably has a lower compressive modulus than that of the upper oriented porous polyester film layer (a), on which an image receiving layer (D) is coated.

In this case, when a high nipping pressure is applied from the sheet conveying nip rolls to the resultant image recording sheet, a major portion of the applied pressure can be absorbed by the lower oriented porous polymer film layer (b) adjacent to the adhesive layer (E) and thus a possible deformation of the upper oriented porous polyester film layer (a) and the image receiving layer (D) formed on the upper film layer (a) can be prevented.

The lower oriented porous polymer film layer (b) adjacent to the adhesive layer (E) and the upper oriented porous polyester film layer (a) adjacent to the image receiving layer (D) are bonded to each other by a dry lamination method, a wet lamination method or calendering method.

In the image recording composite sheet of the present invention, the release layer (B) of the release sheet section (1) comprises a release agent appropriate in combination with the adhesive agent in the adhesive layer (E). Usually, the release agent preferably comprises a silicone resin which exhibits an appropriate peeling property. The release layer (B) is usually formed by coating a release agent-containing liquid on a front surface of a release sheet substrate (A), by, for example, a gravure coater or a bar coater. The dry solid amount of the release layer (B) is preferably 0.3 to 15 g/$m^2$, more preferably 0.5 to 1.2 g/$m^2$. If the amount of the release layer (B) is less than 0.3 g/$m^2$, the resultant release layer (B) may exhibit a significantly uneven releasing performance. Also, if the amount of the release layer (B) is more than 1.5 g/$m^2$, the release performance of the resultant release layer may be saturated and an economical disadvantage may occur.

The release sheet section (1) has a release sheet substrate (A) on which the release layer (B) is coated. The release sheet substrate (A) preferably comprises a laminated paper sheet comprising a base paper sheet comprising, as a principal component, a cellulose pulp, and a polyethylene resin layer laminated at least one surface of the base paper sheet, or a polyolefin synthetic paper sheet or a polyethylene terephthalate synthetic paper sheet.

In the image recording sheet of the present invention, the image recording sheet substrate (C) must be formed from a upper oriented porous polyester film layer (a) and a lower oriented porous polymer (which is different from the polyester) film layer (b) laminated on each other, and the release sheet substrate (A) is preferably formed from an inorganic pigment-containing polypropylene synthetic paper sheet. However the sheet for the release sheet substitute (A) is not limited to the above-mentioned type of sheet.

For the purpose of preventing problems due to static electricity while the image recording sheets moves through a printer, the front surface of the image recording sheet, namely the front surface of the image receiving layer and/or a back surface of the image recording sheet, namely a back surface of the release sheet substrate may be coated with a anti-static layer containing a anti-static agent.

In the image recording composite sheet of the present invention, the image receiving layer (D) comprises a high dye-affinitive (dyeable) resin with the dyes contained in an ink ribbon used in the thermal transfer printer. The dyeable resin preferably comprises at least one member selected from polyester resins, polycarbonate resins, polyvinyl chloride resins, cellulose derivatives. For the purpose of preventing a fuse-adhesion of the ink ribbon to the image receiving layer due to the imagewise heating by the thermal head of the printer, the image receiving layer (D) preferably contains, in addition to the dyeable resin, at least one member selected from cross-linking agents, lubricants, and release agents. Also, optionally, the image receiving layer (D) further contains at least one member selected from fluorescent brightening agents, plasticizers, antioxidants, pigments, and ultra-violet ray absorbers. The above-mentioned additives may be mixed with the dyeable resin for the image receiving layer (D) and the resultant mixed coating liquid is coated on the front surface of the image recording sheet substrate or a coating layer containing the additives may be coated on the image receiving layer (D) surface or arranged between the image receiving layer (D) and the image recording sheet substrate (C).

The image receiving layer can be formed by preparing a coating liquid containing the dyeable resin and, optionally, the additives, coating the coating liquid on the front surface of the image recording sheet substrate (C) and drying the coated coating liquid surface. The coating procedure can be effected by using a conventional coater, for example, a bar coater, a gravure coater, a comma coater, a blade coater, an air knife coater, a curtain coater, a die coater or a lip coater.

The image receiving layer (D) is preferably formed in an amount of 1 to 15 g/$m^2$, more preferably 3 to 10 g/$m^2$. If the amount of the image receiving layer (D) is less than 1 g/$m^2$, the resultant ink receiving layer may not completely coat the image recording sheet substrate (C), and thus the recorded images may have unsatisfactory quality, and when the resultant image receiving layer (D) is heated imagewise by the thermal head of the printer, the ink sheet may be fuse-adhered to the image receiving layer. If the amount of the image receiving layer is more than 15 g/$m^2$, not only the image-receiving effect of the resultant image receiving layer may be saturated, and an economical disadvantage may occur but, also, the coating strength of the image receiving layer (D) may be insufficient and the thickness of the image receiving layer (D) may be too large, and thus the image recording sheet substrate (1) may not realize a sufficient heat-insulating effect and the recorded image may have an insufficient color density.

In the image recording sheet of the present invention, the image receiving layer (D) may be bonded to the upper oriented porous polyester film layer (a) of the image recording sheet substrate (C) through an intermediate layer which enhances the bonding strength between the upper polyester film layer (a) and the image receiving layer (D), and the anti-static property of the image recording sheet section (2). The intermediate layer preferably comprises at least one member selected from vinyl polymers, for example, polyvinyl alcohol and polyvinyl pyrrolidone, and derivatives thereof; poly(meth)acrylic polymers, for example, polyacrylamide, polydimethylacrylamide, polyacrylic acid and salts, polyacrylate esters polymethacrylic acid, polymethacrylate esters; polyester resins; polyurethane resins; natural polymers and modification products thereof, for example, starch, modified starches, carboxymethyl cellulose. The intermediate layer optionally further contains conventional anti-static agent and/or cross-linking agents, which may be used alone or in a mixture of two or more thereof.

Usually, the intermediate layer is formed in a dry solid amount of 0.2 to 5 g/m$^2$, more preferably 0.5 to 3 g/m$^2$. If the amount of the intermediate layer is less than 0.2 g/m$^2$, the resultant layer may not exhibit a satisfactory bonding effect. Also, if the amount of the intermediate layer is more than 5 g/m$^2$, the resultant layer may exhibit an insufficient coating strength and may cause the resultant image recording sheets to block the sheet supply into, and delivery from, the printer and to decrease the working efficiency.

The intermediate layer can be formed by the same manner as for the image receiving layer.

The image receiving layer surface and/or the intermediate layer surface are optionally smoothed by calendering or heat-pressing, using, for example, a super-calender.

In the image recording composite sheet of the present invention, a ratio ($TH_C/TH_A$) of the thickness $TH_C$ of the substrate sheet (C) of the image receiving sheet section (2) to the thickness $TH_A$ of the substrate sheet (A) of the release sheet section (1) is preferably in the range of from 0.35 to 2.5, more preferably from 0.5 to 2.0.

If the ratio ($TH_C/TH_A$) is less than 0.35, the small thickness $TH_C$ of the image recording sheet substrate may cause the resultant image recording sheet to be greatly curled during image recording procedure of the printer, and to be easily wrinkled when the image recording sheet section (2) is released from the release sheet section (1) so that the commercial value of the resultant image receiving sheet is reduced. Also, if the ratio ($TH_C/TH_A$) is more than 2.5, the small thickness of the release sheet substrate (A) may cause the release sheet section (1) to be difficult to smoothly adhere to the image recording sheet section (2) while controlling the generation of curling phenomenon on the adhered sections, and the resultant image recording sheet to exhibit an undesirable curling phenomenon, occurring immediately after adhering procedure or during storage of the resultant image recording sheet. The curled sheets are unsatisfactory in appearance and have a low commercial value.

In the image recording composite sheet of the present invention, the release sheet section (1) preferably further comprises a backing resin layer (F) coated on the back surface (free from the release layer (B)) of the release sheet substrate (A). The backing resin layer (F) may be formed from a mixture of a flexible resin with an anti-static agent or from an anti-static flexible resin. The backing resin layer F contributes to enhancing the smooth-feeding, moving, or delivering property of the resultant image recording sheets into, through or from the thermal transfer printer.

The anti-static agent for the backing resin layer (F) can be selected from conventional cationic anti-static agents, for example, cation-modified starches; anionic anti-stating agents and nonionic anti-stating agent, and is contained in an appropriate content in the backing resin layer (F). The anti-static flexible resins usable for the backing resin layer are preferably selected from polyethylene-imine, cationic monomer-copolymerised acrylic resins and cation-modified acrylamide resins. The backing resin layer may further comprises a binder comprising at least one member selected from water-soluble resins, for example, polyvinyl alcohol; and acrylic resins, epoxy resins, polyester resins, phenol resins, alkyl resins, polyurethane resins, melamine resins and hardening reaction products of the above-mentioned resins. Further, the backing resin layer (F) optionally contains at least one member selected from fillers such as inorganic pigment particles and organic pigment particles, as a friction-modifier.

The backing resin layer (F) is preferably formed in a dry solid amount of 0.3 to 10 g/m$^2$, more preferably 1 to 5 g m$^2$. If the amount of the backing resin layer (F) is less than 0.3 g/m$^2$, damage to the surfaces of the resultant ink recording sheets facing each other, due to friction between the facing surfaces of the sheets, may not be fully prevented. Also, if the backing resin layer (F) amount is more than 10 g/m$^2$, the desired effects of the layer may be saturated and economical disadvantages may occur.

The backing resin layer can be formed on the back surface of the release sheet substrate (A) by a conventional coating method as mentioned above.

In another embodiment of the thermal transfer image recording composite sheet of the present invention, the release sheet section (1) and the image recording sheet section (2) have the same constitution as that of the above-mentioned embodiment, except that the image recording sheet substrate (C) and the adhesive layer (E) are changed as follows.

In this embodiment, the ink recording sheet substrate (C) is formed, in response to the type, composition and thickness of the release sheet substrate (A), from at least one sheet material selected from, for example, paper sheets, for example, coated paper sheets, art paper sheets, woodfree paper sheets and foamed paper sheets; laminated paper sheets comprising, for example, paper sheets substrates laminated on at least one surface of each substrate with a thermoplastic resin layer, for example, a polyethylene layer; films of thermoplastic resins, for example, polyester resins (for example, polyethylene terephthalate resin), polyamide resins, polyolefin resins (for example, polypropylene resin); oriented porous polymer films prepared by forming a melt of a mixture of a thermoplastic resin and a pore-forming component into an undrawn film and monoaxially or biaxially drawing the undrawn film while allowing a plurality of pores to be generated; and multi-layered film produced by successively or simultaneously laminating a plurality of films, for example, porous films, on each other. The above-mentioned sheet materials may be employed alone or in a combination of two or more.

In the combination, a plurality of sheet materials are laminated on each other thereof by a dry lamination method, wet lamination method or melt lamination method, to form a multilayered composite sheet or film. In the composite porous film, the pores may be evenly distributed throughout all the component films or only in one or more, but not all, of the component films.

The image recording sheet substrate (C) of the image recording sheet section (2) preferably comprises an oriented porous film comprising, as a principal component, a polyester or a polyolefin. The oriented porous film has a plurality of pores (microvoids) and thus exhibits a low thermoconductivity and a good heat-insulating property. When the oriented porous film is employed as a image recording sheet substrate (C), it contributes to preventing unnecessary diffusion of heat through the resultant recording sheet during a image recording procedure and to enhancing the image recording sensitivity of the recording sheet.

The oriented porous polyester film is produced, for example, by forming an undrawn film from a melt of a mixture comprising a matrix polyester resin and at least one member selected from particulate resins and inorganic and organic fillers each incompatible with the matrix polyester resin; and drawing the undrawn film in at least one direction, to cause a plurality of fine pores to be formed in the resultant the oriented polyester film.

The oriented porous polyolefin (particularly polypropylene resin) film in produced, for example, by forming an undrawn polyolefin film from a mixture of a polyolefin resin, for example, a polypropylene resin, with an inorganic filler and/or an organic filler; and drawing the undrawn polyolefin film in at least one direction to form a synthetic paper sheet in which a plurality of fine pores are distributed.

The pore-forming component includes resins incompatible with the polyester resins, for example, polyethylene, polypropylene, polyacrylonitrile, polyvinyl chloride and polystyrene resins and mixtures of two or more of the resins.

The inorganic fillers for the porous polyester or polyolefin films include inorganic white pigments, for example magnesium oxide, aluminum oxide, titanium dioxide, silicon oxide, calcium carbonate, magnesium carbonate, barium sulfate, calcium silicate and mixtures of two or more of the above-mentioned pigments.

The inorganic pigments are preferably contained in an amount of 5 to 30% by mass in the film.

The thickness of the image recording sheet substrate (C) of the image recording sheet section (2) is preferably 20 to 200 μm, more preferably 50 to 180 μm. If the thickness is less than 20 μm, the resultant image recording sheet section (2) may have an insufficient mechanical strength, stiffness and recovery from deformation or repulsion to deformation and may not sufficiently present curling of the recording sheet during the image recording. Also, if the thickness of the image recording sheet section (2) is less than 20 μm, when the section (2) is used as an adhesive label, the stiffness and repulsion to deformation of the label may be insufficient and when the image recording sheet section (2) is separated from the release sheet section (1), the image recording sheet section (2) may be wrinkled and the commercial value of the printed image recording sheet section (2) may be lost. Further if the thickness of the image recording sheet substrate (C) is more than 200 μm, the resultant recording sheet may have too large a thickness, and thus the maximum number of the recording sheet contained in the sheet tray of the printer may be too small, and thus the capacity of the sheet tray may have to be increased. This need may cause a necessity of increasing the dimensions of the printer and it becoming difficult to make the printer compact.

In this embodiment of the recording composite sheet of the present invention, the adhesive layer (E) further comprises a plurality of hollow particles each constituted from at least one core hollow portion and a shell portion comprising a polymeric material and surrounding and closing the core hollow portion, the hollow particles having an average particle size of 0.3 to 30 μm, preferably 0.3 to 25 μm.

The hollow particles dispersed and distributed in the adhesive layer contribute to decreasing the compressive modulus of the image recording sheet, to impart an appropriate degree of freedom of deformation of the image recording sheet and to enhance a follow-up property of the image recording sheet to the forms and conditions of the thermal head and ink ribbon of the printer and a close adhesion of the image recording sheet to the thermal head and the ink ribbon. Thus, in a high energy printing procedure of a high speed printer, printing failures of images on the ink recording sheet due to wrinkles generated on the ink ribbon can be prevented. Also, when high pressures, due to the thermal head and sheet-conveying rolls are applied onto the image recording sheet, the stresses corresponding to the pressures can be absorbed by the image recording sheet containing the hollow particles. Thus, the resistance to the image recording sheet of the present invention to the denting and spike marks due to the nipping pressure of the sheet-conveying nip rolls is increased. Also, the distribution of the hollow particles in the adhesive layer contributes to enhancing the heat insulating property of the image recording sheet, and therefore, the heat efficiency of the thermal head of the printer on the image recording sheet even when the thermal head works in a low energy condition, and the color density and clarity of the recorded images on the image recording sheet are improved.

There is no limitation to the method of producing the hollow particles. The hollow particles may be selected from those mentioned as follows.

(i) Foamed hollow particles produced by heat-foaming particles comprising a thermoplastic polymer material and a thermal expansion substance mixed into the thermoplastic polymer material:

(ii) Microcapsules produced by forming precursor microcaplules each comprising a core portions consisting of a volatile liquid and a shell portion comprising a thermoplastic polymer material and surrounding the core portion by a microcapsule-polymerization method, and evaporating away the volatile liquid from the precursor microcapsules, to form microcapsules each having a hollow core surrounded and closed by a shell.

The hollow particles may be produced by forming a non-foamed adhesive layer containing non-foamed particles formed from a thermoplastic resin mixed with a thermally expansible substance and allowing the thermally expansible substance to expand in the thermoplastic resin particles in the adhesive layer by heating during a heat-drying procedure in the process for producing an image recording sheet or during thermal transfer recording procedure, so as to convert the thermoplastic resin particles to a hollow particles having at least one hollow.

However, this method may be disadvantageous in that when the thermoplastic resin particles containing the thermally expansible substance are heated during the process for producing the image recording sheet, it is difficult to evenly foam the particles to provide hollow particles having a uniform particle size, and thus the resultant hollow particle-containing adhesive layer has a roughened surface which causes the uniformity of the recorded images to be uneven, and the clarity of the recorded images to be low.

In the case where the expansible particle-containing, non-foamed adhesive layer is foamed by heating in the thermal transfer recording procedure, a portion of heat energy for the thermal transfer and fixing of the images is consumed for the thermal expansion of the expansible particles, and thus the energy efficiency of the recording procedure for the resultant image recording sheet may be low. Therefore, in the present invention, the adhesive layer preferably contains the hollow particles each having at least one hollow portion having been formed before the thermal transfer recording procedure.

The foamed hollow particles obtained by thermally expanding the thermal expansible substance contained in the individual thermal plastic particles is usually produced by forming precursor particles in each of which a volatile hydrocarbon having a low boiling temperature, for example, n-butane, i-butane, pentane and/or neopentane is mixed, as a thermally expansible core substance, into a thermoplastic resinous material, for example, a homopolymer or copolymer of vinylidene chloride and acrylonitrile, as a shell-forming material, and applying a treatment for expanding the expansible core substance, for example, a heating procedure, to the precursor particles to convert the precursor particles to hollow particles having a desired particle size. As the above-mentioned type of foamed or non-foamed hollow particles, foamed products under the trademarks of EXPANCELL 551DE20, 461DE and 461DE20 made by NIPPON FERRITE K.K and non-foamed products under the trademarks of MATSUMOTO MICROSPHERE MEL-80GCA, 100SCA and 30STI made by MATSUMOTO YUSHI K.K, are available in trade.

The foamed hollow particles prepared by thermally expanding the thermally expansible substance-containing thermoplastic material particles usually have a low specific gravity. Thus, for the purpose of enhancing the handle-operativity and the dispersibility of the foamed hollow particles in practice, the foamed hollow particles is surface-treated by applying inorganic particles, for example, fine particles of calcium carbonate, talc, and/or titanium dioxide onto a melted surface of the foamed follow particles, to provide foamed hollow composite particles in which the surfaces of the foamed hollow particle substrates are coated with the fine inorganic particles.

Practical products under the trademarks of MATSUMOTO MICROSPHERE MFL-80GCA, 100SCA and 30STI, made by MATUMOTO YUSHI K.K are available in the trade.

The foamed hollow particles usable for the present invention preferably has an average diameter of 0.3 to 30 μm, more preferably 0.4 to 25 μm, still more preferably 0.5 to 20 μm.

The foamed hollow particles obtained by thermally expanding precursor particles containing a thermally expansible substance mixed into a thermoplastic material exhibit higher cushoning effect and softness than those of the microcapsule-type hollow particles. Usually, the foamed hollow particles having an average particle size of 30 μm or less are usable for the present invention. If the average particle size is less than 0.3 μm, the resultant image recording sheet may have too high a compressive modulus and too low a cushioning effect, and thus the formation of wrinkle marks transferred from the ink ribbon to the image recording sheet may not be sufficiently prevented. Also, if the average particle size is more than 30 μm, the resultant adhesive layer may have an insufficient smoothness and the recorded images on the resultant image recording sheet may exhibit insufficient uniformity and clarity.

The microcapsule-type hollow particles usable for the present invention are produced by preparing precursor microcapsule particles comprising at least one cores formed from a volatile liquid, for example water, and a shell formed from a hard polymeric material, for example, a styrene-acrylic monomer copolymer or melamine-formaldehyde resin and surrounding and closing the core; and drying the precursor microcapsule particles to an extent such that the core volatile liquid is evaporated away to form a hollow core surrounded by the shell. The precursor microcapsules can be produced by subjected a polymer-forming material (shell-forming material) and a volatile liquid (hollow or pore-forming material to a microcapsule-forming polymerization procedure. As microcapsule type hollow particles, products under the trademarks, for example, JSR-SX863A and SX864 made by NIHON GOSEIGOMU K.K, ROPAK OP-84J, OP-62 and HP-91, made by Rohm & Hass CO. and HONEN MICROSPHERE MB-923 and 925, made by HONEN CORPORATION, are available in the trade.

The microcapsule type hollow particles usable for the present invention preferably have an average particle size of 0.3 to 30 μm, more preferably 0.3 to 10 μm, still more preferably 0.4 to 8 μm, further preferably 0.5 to 7 μm. If the particle size of the microcapsule type hollow particles is less than 0.3 μm, the resultant image recording sheet may have too high a compressive modulus and exhibit too low a cushoning effect. Thus, the resultant image recording sheet may exhibit an insufficient effect on prevention of the transfer of wrinkles of the ink ribbon to the image recording sheet and the formation of nipping marks and concavities by the sheet-conveying nip rolls. If the average particle size is more than 30 μm, the resultant adhesive layer may have an insufficient smoothness and the recorded images on the resultant image recording sheet may exhibit insufficient uniformity.

In the adhesive layer (E) of the image recording sheet of the present invention, the hollow particles are preferably contained in a content of 0.1 to 2.5% by mass, more preferably 0.2 to 2% by mass, based on the dry solid mass of the adhesive agent. If the content of the hollow particles is less than 0.1% by mass, the resultant image recording sheet may exhibit too high a compressive modulus and a insufficient cushoning effect and, thus, the prevention of the thermal transfer of the wrinkles marks from the ink ribbon to the recording surface and of the formation of concavities and the spike marks on the image recording sheet due to the sheet-conveying nip rolls may be unsatisfactory. Also, if the content of the hollow particles is more than 2.5% by mass, the resultant adhesive layer may exhibit an insufficient smoothness, the recorded images on the resultant image recording sheet may have a insufficient uniformity, and thus the resultant image recording sheet may not exhibit satisfactory recording effect.

The adhesive layer (E) is preferably formed in a dry solid amount of 5 to 30 g/m$^2$, more preferably 6 to 27 g/m$^2$. If the dry solid amount of the adhesive layer is less than 5 g/m$^2$, the back surface of the image recording sheet substrate (C) may not be completely coated by the adhesive layer (E), the adhesive property of the resultant image recording sheet section (2) may be insufficient, the resultant image recording sheet may have too high a compressive modulus, and thus the prevention of the thermal transfer of the wrinkle marks from the ink ribbon and the compression marks due to the nipping pressure of the sheet-conveying nip rolls may become insufficient. Also, if the dry solid amount of the adhesive layer is more than 30 g/m$^2$, the cushoning effect of the resultant adhesive layer may be saturated and an economical disadvantage may occur, and a portion of the adhesive agent may bulge out of the adhesive layer (E).

EXAMPLES

The present invention will be further illustrated by the following examples which are not intended to limit the scope of the present invention in any way.

Example 1

In the preparation of an image recording sheet substrate (C) of a image recording sheet, an oriented porous polyethylene terephthalate film having a thickness of 50 μm, a basis mass of 50 g/m$^2$, a compressive modulus of 50 MPa (trademark: 50E63S made by TORAY) was used for an upper oriented porous polyester film layer (a) on a front surface of which an image receiving layer (D) was to be formed; and a porous synthetic paper sheet having a thickness of 60 μm, a basis mass of 45 g/m$^2$ and a compressive modulus of 7 MPa (trademark: YUPO FPG60, made by YUPO corporation) was used for a lower oriented porous polymer film layer (b) on a back surface of which an adhesive layer (E) was to be coated.

The upper polyester film was laminated on the lower polymer film through a polyester binder by a dry lamination method, to provide an image recording sheet substrate (C) having a dry solid mass of 4 g/m$^2$.

A coating liquid for an image receiving layer (D) was prepared as the composition 1 shown below Coating liquid 1 (Image receiving layer)

| Component | Parts by mass |
|---|---|
| Polyester resin (Trademark: VYLON200, made by TOYOBO K. K.) | 100 |
| Silicone resin (Trademark: KF 393) made by SHINETSU KAGAKUKOGYO K. K.) | 3 |
| Isocyanate (Trademark: TAKENAT D-140N, made by TAKEDA YAKUHIN K. K.) | 5 |
| Toluene | 300 |

The coating liquid of the composition 1 was coated on a front surface of the upper polyester film layer (a) by a die coating method and dried to form an image receiving layer (D) having a dry solid mass of 8 g/m$^2$.

Another coating liquid for an adhesive layer was prepared from a mixture as the composition 2 shown below.

Composition 2 (Adhesive layer)

| Component | Parts by mass |
|---|---|
| Acrylic binder (Trademark: AT191, made by SAIDEN KAGAKU K. K.) | 100 |
| Epoxy curing agent (Trademark: A-51) made by SAIDEN KAGAKU K. K.) | 2.25 |

The composition was diluted into a concentration of 20% by mass with ethyl acetate.

This coating liquid was coated on the back surface of the lower polymer film layer (b) of the image recording sheet substrate (C) by a gravure coating method and dried to provide an adhesive layer (E) having a dry solid mass of 16 g/m$^2$. An image recording sheet section (2) was obtained.

A porous polyester film having a thickness of 100 μm, a basis mass of 100 g/m$^2$ and a compressive modulus of 45 MPa (trademark: W900E100, made by MITSUBISHI KAGAKU POLYESTER K.K.) was employed as a release sheet substrate (A) for a release sheet section (1).

As a coating liquid for a release layer (B), a silicone release agent (trademark: KS-830, made by SHINETSU KAGAKUKOGYO K.K.) was coated on a front surface of the release sheet substrate (A) by a gravure coating method and dried to form a release layer (B) having a dry solid mass of 0.6 g/m$^2$.

A coating liquid for a backing resin layer (F) was prepared as the composition 3 shown below.

Composition 3 (Backing resin layer (F))

| Component | Parts by mass |
|---|---|
| Acrylic resin (Trademark: RIKABOND SAR-615A, made by CHUO RIKA K. K.) | 100 |
| Epoxy curing agent (trademark: RIKABOND SAR-615B, made by Chuo RIKA K. K.) | 5 |
| Electrical conductive agent (trademark: ST2000H, made by MITSUBISHI YUKASEI K. K.) | 75 |
| Silica pigment (trademark: P78A, made by MIZUSAWA KAGAKU K. K.) | 30 |

The coating liquid of the composition 3 was coated on a back surface of the release sheet substrate (A) by a bar coating method and dried to form an anti-static backing resin layer (F) having a dry solid mass of 1 g/m$^2$. A release sheet section (1) was obtained.

The adhesive layer (E) of the image recording sheet section (2) was adhered to the release layer (B) of the release sheet section (1), to provide a thermal transfer image recording composite sheet.

Example 2

A thermal transfer image recording composite sheet was produced by the same procedures as in Example 1 with the following exceptions.

The porous synthetic paper sheet (Trademark: YUPO FPG60) for the lower oriented porous polymer film layer (b) was replaced by a porous polypropylene film having a thickness of 55 μm, a basis mass of 30 g/m$^2$ and a compressive modulus of 5 MPa (trademark: 260 LLG 302, made by MOBILE).

Example 3

A thermal transfer image recording composite sheet was produced by the same procedures as in Example 1 with the following exceptions.

The porous synthetic paper sheet (trademark: YUPO FPG60) for the lower oriented porous polymer film layer (b) was replaced by an oriented porous polyester film having a thickness of 38 μm, a basis mass of 38 g/m$^2$ and a compressive modulus of 15 MPa (trademark: CRISPER, made by TOYOBO K.K.).

Example 4

A thermal transfer image recording composite sheet was produced by the same procedures as in Example 1 with the following exceptions.

The porous synthetic paper sheet (trademark: YUPO FPG60) for the lower oriented porous polymer film layer (b) was replaced by a porous polypropylene film having a thickness of 110 μm, a basis mass of 82.5 g/m$^2$ and a compressive modulus of 5 MPa (trademark: YUPO FPG 110, made by YUPO CORP.).

Example 5

A thermal transfer image recording composite sheet was produced by the same procedures as in Example 1 with the following exceptions.

The porous polyester film (trademark: 50E 63S) for the image recording sheet substrate was replaced by a porous film comprising, as a principal component, polyethyleneterephthalate and having a thickness of 38 μm, a basis mass of 40 g/m$^2$ and a compressive modulus of 15 MPa (trademark: CRISPER, made by TOYOBO K.K.).

The porous synthetic paper sheet (trademark: YUPO FPG60) for the lower oriented porous polymer film layer (b) was replaced by a porous polypropylene film having a thickness of 130 μm, a basis mass of 98 g/m$^2$ and a compressive modulus of 6 MPa (trademark: YUPO FPG 130, made by YUPO CORP.).

Comparative Example 1

A thermal transfer image recording composite sheet was produced by the same procedures as in Example 1 with the following exceptions.

The porous synthetic paper sheet (trademark: YUPO FPG60) for the lower oriented porous polymer film layer (b) was replaced by a coated paper sheet having a basis mass of 157 g/m$^2$ and a compressive modulus of 86 MPa (trademark: OK TOPCOAT N, made by OJI PAPER CO., LTD.).

Comparative Example 2

A thermal transfer image recording composite sheet was produced by the same procedures as in Example 1 with the following exceptions.

The porous synthetic paper sheet (trademark: YUPO FPG60) for the lower oriented porous polymer film layer (b) was replaced by a polyester film having a thickness of 100 μm and a compressive modulus of 86 MPa (trademark: EMBLET, made by UNITIKA K.K.).

Comparative Example 3

A thermal transfer image recording composite sheet was produced by the same procedures as in Example 1 with the following exceptions.

The porous polyester film (trademark: 50E63S) for the upper oriented porous polyester film layer (a) was replaced by a porous synthetic paper sheet (trademark: FPU 60, made by YUPO CORP.) having a thickness of 60 μm and a compressive modulus of 7 MPa.

Samples of the image recording sheet of Examples 1 to 5 and Comparative Examples 1 to 3 were subjected to the following tests and evaluations.

(1) Compressive Modulus

The compressive modulus of each sample was measured in accordance with JIS K 7220. In the measurement, the height of the test piece was represented by a thickness of the sample and the compression was carried out at a compression rate of 20 μm/minute.

(2) Resistance to Denting of Image Recording Sheet

A thermal transfer video printer (trademark: M1, made by SONY) was modified to a tester having sheet-conveying nip rolls working under a high nipping pressure. The nipping pressure of the tester was 200 kg/cm$^2$, determined by using pressure testing films (trademark: Prescale, made by FUJI PHOTOGRAPHIC FILM K.K.).

The dent resistance of the samples of the image recording sheets measured by the tester was evaluated by naked eye-observation, into the following three classes.

| class | Resistance to denting |
|---|---|
| 3 | No denting is found |
| 2 | Slight denting are found |
| 1 | Significant denting are found |

(3) Quality of recorded images (color density, uniformity of images, and denting resistance of recorded portions)

A coloring ink ribbon was prepared by coating a polyester film having a thickness of 6 μm with three ink layers each comprising a binder and a yellow, magenta or cyan-coloring sublimating dye, and arranged repeatedly on the film.

The samples of the image recording sheets were subjected to a printing test in which each sample was brought into contact with the ink ribbons by a thermal transfer video printer (trademark: DR100, made by SONY) and heated imagewise by a thermal head at various temperatures changing stepwise, to provide recorded images in yellow, magenta or cyan simple color or in various mixed colors formed by superposing two or more colors on each other.

The color densities of the recorded images on the samples of the image recording sheets were measured by using MACBETH reflective color density tester (Model: RD-914). The color density of each image was represented by a high gradation color density corresponding to an applied energy amount in the sixteenth step from a lowest step.

Also, with respect to the uniformity of recorded images in a gradation step corresponding to a color density of 1.0, namely a black color, (1) uniformity in color density of the recorded images and (2) defective transfer of coloring dye image were observed by naked eye and evaluated.

Further, the roughness of portions recorded with images having a highest color density of about 2.2 were observed by naked eye, to evaluate the smoothness of the image-recorded portions.

The evaluation results were shown in the following three classes.

| class | Evaluation |
|---|---|
| 3 | Excellent |
| 2 | Good |
| 1 | The uniformity in color density, the transfer of coloring dye image and/or the smoothness and denting resistance of image-recorded portions are unsatisfactory |

(4) Brightness Measurement

The Hunter brightness of the image recording sheet substrate and the recording sheet were determined in accordance with JIS P 8123 using a Hunter reflectance meter. The spectal properties of the brightness are established based on a product of spectral sensitivities of a light source, a blue filter and a photocell, with each other. In this measurement, a light having a main wavelength of 457 nm was irradiated at an incidence angle of 45 degrees and received at an angle of 0 degree.

The back surface of the sample was backed with the same sheets as the sample to an extent such that the measurement data become constant. As a standard plate, a magnesium oxide plate having a brightness of 100% was used.

(5) Opacity Measurement

The opacities of the image recording sheet substrate and the recording sheet were determined in accordance with JIS P8138 using a Hunter reflectance meter with a green filter, and calculated in accordance with the following equation.

$$C=100\times R_0/R_{0.89}$$

wherein C represents an opacity in % (calculate down to the first decimal place), $R_0$ represents a reflectance in % when the sample is backed with a black colored plate, and $R_{0.89}$ represents a reflectance in % when the sample was backed with a white plate having a reflectance of 89%.

The test results are shown in Table 1.

TABLE 1

| Example No. | | Recording sheet: Compressive modulus (MPa) | Recording sheet: Denting resistance | Recorded images: Color density of high gradation images | Recorded images: Uniformity of images | Recorded images: Smoothness of image recorded portions | Image receiving layer (D): Hunter brightness (%) | Image receiving layer (D): Hunter opacity (%) | Image recording sheet substrate: Hunter brightness | Image recording sheet substrate: Hunter opacity |
|---|---|---|---|---|---|---|---|---|---|---|
| Example | 1 | 10 | 2 | 2.23 | 3 | 3 | 83.0 | 93.0 | 82.8 | 93.0 |
| | 2 | 8 | 2 | 2.22 | 3 | 3 | 83.0 | 93.0 | 82.9 | 93.0 |
| | 3 | 17 | 3 | 2.23 | 3 | 3 | 82.0 | 82.0 | 81.7 | 82.0 |
| | 4 | 8 | 3 | 2.23 | 3 | 3 | 85.0 | 96.0 | 85.0 | 96.0 |
| | 5 | 7 | 3 | 2.20 | 3 | 3 | 84.0 | 98.0 | 84.0 | 98.0 |
| Comparative Example | 1 | 73 | 1 | 2.19 | 2 | 3 | 76.0 | 97.0 | 76.0 | 97.0 |
| | 2 | 84 | 1 | 2.18 | 3 | 3 | 76.0 | 87.0 | 76.0 | 87.0 |
| | 3 | 7 | 1 | 2.05 | 2 | 1 | 86.0 | 94.1 | 86.1 | 94.1 |

Example 6

(1) Substrate (C), Image Receiving Layer (D) and Intermediate Layer of Image Recording Sheet Section (2)

A biaxially oriented porous polyethylene terephthalate film containing an inorganic pigment and having a thickness of 75 μm (trademark: W900 J75, made by MITSUBISHI KAGAKU POLYESTER FILM K.K.) was used as a substrate (C) for an image recording sheet section (2).

A coating liquid for an intermediate layer was prepared as the composition 4 shown below.

Composition 4 (Intermediate layer)

| Components | Parts by mass |
|---|---|
| Polyethyleneimine (trademark: PP-061, made by NIHON SHOKUBAI K. K.) | 4 |
| Ethyl alcohol | 100 |

The coating liquid (4) was coated on a front surface of the image recording sheet substrate by using a bar coating method and dried to form an intermediate layer having a dry solid amount of 0.5 g/m$^2$.

A coating liquid for an image receiving layer (D) was prepared as the composition 5 shown below.

Composition 5 (Image receiving layer (D))

| Components | Parts by mass |
|---|---|
| Polyester resin (trademark: Vylon 200, made by TOYOBO K. K.) | 100 |
| Silicone oil (trademark: KF 393, made by SHINETSU KAGAKUKOGYO K. K.) | 2 |
| Isocyanate (trademark: TAKENATE D-110N, made by TAKEDA YAKUHIN K. K.) | 6 |
| Toluene/methylethylketone (1/1 by mass) mixture | 350 |

The coating liquid 5 was coated on the intermediate layer by a gravure coating method and dried, to form an image receiving layer (D) having a dry solid amount of 6 g/m$^2$.

(2) Adhesive Layer

A coating liquid for an adhesive layer was prepared in the composition 6 shown below.

Composition 6 (Adhesive layer)

| Components | Parts by mass |
|---|---|
| Acrylic adhesive agent (trademark: PE-115E, made by NIHON CARBIDE K. K.) | 100 |
| Isocyanate curing agent (trademark: CK101, made by NIHON CARBIDE K. K.) | 1 |
| Foamed composite hollow particles (trademark: MATSUMOTO MICRO SPHERE MFL-80GCA, made by MATSUMOTO YUSHI K. K.) having an average particle size of 20 μm and a apparent specific gravity of 200 kg/m$^3$ | 0.5 |

The coating liquid 6 was coated on a back surface of the image recording sheet substrate (C) by a gravure coating method and dried at 100° C., to form an adhesive layer in a dry solid amount of 15 g/m$^2$.

(3) Release Sheet Section and Lamination

As a substrate (A) for a release sheet section (1), a biaxially oriented porous polyethylene terephthalate film containing an inorganic pigment and having a thickness of 100 μm (trademark: W900 E100, made by MITSUBISHI POLYESTER FILM K.K.) was employed.

A front surface of the release sheet substrate (A) was coated with a silicone release agent (trademark: KS830, made by SHINETSU KAGAKUKOGYO K.K.) by a gravure coating method and dried to form a release layer (B) having a dry solid amount of 0.5 g/m$^2$.

A liquid coating liquid for a backing resin layer (F) was prepared as the composition 7 shown below.

Composition 7 (Backing resin layer (F))

| Components | Parts by mass |
|---|---|
| Acrylic resin (trademark: RIKABOND SAR-615A, made by CHUO RIKA K. K.) | 100 |
| Cationic electroconductive agent (trademark: ST 2000H, made by MITSUBISHI YUKA K. K.) | 75 |
| Silica pigment (trademark: PM 363, made by MIZUSAWA KAGAKU K. K.) | 30 |
| Isopropyl alcohol | 300 |
| Toluene | 200 |

The back surface of the release sheet substrate (A) was coated with the coating liquid 7 by a bar coating method and dried to form a backing resin layer (F) in a dry solid amount of 1.3 g/m$^2$.

The resultant release sheet section (1) was laminated on the image recording sheet section (2) in such a manner that the release layer (A) surface of the release sheet section (1) is brought into contact with the adhesive layer (E) surface of the image recording sheet section (2), to provide a thermal transfer image recording composite sheet.

Example 7

A thermal transfer image recording composite sheet was produced by the same procedures as in Example 6, except that in the coating liquid 6 for the adhesive layer (E), the foamed composite hollow particles (trademark: MATSUMOTO MICROSPHERE MFL-80GCA) were replaced by another foamed hollow particles having an average particle size of 20 μm and a specific gravity of 60 kg/m$^3$ (trademark: EXPANCELL 551DE 20, made by NIHON FERITE K.K.).

Example 8

(1) Substrate (C), Image Receiving Layer (D) and Intermediate Layer of Image Recording Sheet Section (2)

A biaxially oriented porous polyethylene terephthalate film containing an inorganic pigment and having a thickness of 75 μm (trademark: W 900 J75, made by MITSUBISHI KAGAKU POLYESTER FILM K.K.) was used as a substrate (C) for an image recording sheet section (2).

A coating liquid for an intermediate layer was prepared as the composition 8 shown below.

Composition 8 (Intermediate layer)

| Components | Parts by mass |
|---|---|
| Acrylic resin (trademark: RIKABOND SAR-615A, made by CHUO RIKA K. K.) | 40 |
| Epoxy resin (trademark: RIKABOND SAR-615B, made by CHUO RIKA K. K.) | 5 |
| Cationic electroconductive agent (trademark: Chemistat 9800, made by SANYO KASEI K. K.) | 50 |
| Isopropyl alcohol | 450 |
| Water | 150 |

The coating liquid 8 was coated on a front surface of the image recording sheet substrate by using a bar coating method and dried to form an intermediate layer having a dry solid amount of 1.2 g/m$^2$.

A coating liquid for an image receiving layer (D) was prepared as the composition 9 shown below.

Composition 9 (Image receiving layer (D))

| Components | Parts by mass |
|---|---|
| Polyester resin (trademark: Vylon 200, made by TOYOBO K. K.) | 100 |
| Silicone oil (trademark: KF 393, made by SHINETSU KAGAKUKOGYO K. K.) | 3 |
| Isocyanate (trademark: TAKENATE D-120N, made by TAKEDA YAKUHIN K. K.) | 5 |
| Hindered amine photostabilizer (trademark: ADECASTAB LA-63, made by ASAHI DENKAKOGYO K. K.) | 3 |
| Toluene/methylethylketone (1/1 by mass) mixture | 400 |

The coating liquid 9 was coated on the intermediate layer by a gravure coating method and dried, to form an image receiving layer (D) having a dry solid amount of 5 g/m$^2$.

(2) Adhesive Layer

A coating liquid for an adhesive layer was prepared as the composition 10 shown below.

Composition 10 (Adhesive layer)

| Components | Parts by mass |
|---|---|
| Acrylic adhesive agent (trademark: TS-1224L, made by NIHON CARBIDE K. K.) | 100 |
| Microcapule type hollow particles (trademark: LOPAQUE OP-84J, made by ROHM & HASS) having an average particle size of 0.55 μm | 0.5 |

The coating liquid 10 was coated on a back surface of the image recording sheet substrate (C) by a gravure coating method and dried at 110° C., to form an adhesive layer in a dry solid amount of 15 g/m$^2$.

(3) Release Sheet Section and Lamination

As a substrate (A) for a release sheet section (1), a biaxially oriented porous polyethylene terephthalate film containing an inorganic pigment and having a thickness of 100 μm (trademark: W 900 E100, made by MITSUBISHI POLYESTER FILM K.K.) was employed.

A front surface of the release sheet substrate (A) was coated with a silicone release agent (trademark: KS830, made by SHINETSU KAGAKUKOGYO K.K.) by a gravure coating method and dried to form a release layer (B) having a dry solid amount of 0.5 g/m$^2$.

A liquid coating liquid for a backing resin layer (F) was prepared as the composition 11 shown below.

Composition 11 (Backing resin layer (F))

| Components | Parts by mass |
|---|---|
| Acrylic resin (trademark: RIKABOND SAR-615A, made by CHUO RIKA K. K.) | 50 |
| Epoxy curing agent (trademark: RIKABOND SAR-618B, made by CHUO RIKA K. K.) | 5 |
| Cationic electroconductive agent (trademark: ST 2000H, made by MITSUBISHI YUKA K. K.) | 50 |
| Silica pigment (trademark: PM 363, made by MIZUSAWA KAGAKU K. K.) | 20 |
| Isopropyl alcohol | 350 |
| Toluene | 150 |

The back surface of the release sheet substrate (A) was coated with the coating liquid 11 by a bar coating method and dried to form a backing resin layer (F) in a dry solid amount of 1.8 g/m$^2$.

The resultant release sheet section (1) was laminated on the image recording sheet section (2) in such a manner that the release layer (A) surface of the release sheet section (1) is brought into contact with the adhesive layer (E) surface of the image recording sheet section (2), to provide a thermal transfer image recording composite sheet.

Example 9

A thermal transfer image recording composite sheet was produced by the same procedures as in Example 8, except that in the coating liquid 10 for the adhesive layer (E), the microcapsule type hollow particles (trademark: LOPAQUE OP-84J) were replaced by another microcapsule type hollow particles having an average particle size of 7 μm (trademark: HONEN MICROSPHERE MB927, made by HONEN CORP.).

Example 10

(1) Substrate (C), Image Receiving Layer (D) and Intermediate Layer of Image Recording Sheet Section (2)

A biaxially oriented porous polyethylene terephthalate film containing an inorganic pigment and having a thickness of 50 μm (trademark: 50 E63S, made by TORAY K.K.) was used as a substrate (C) for an image recording sheet section (2).

A coating liquid for an intermediate layer was prepared as the composition 12 shown below.

Composition 12 (Intermediate layer)

| Components | Parts by mass |
|---|---|
| Cationic electroconductive agent (trademark: ST 2000H, made by MITSUBISHI KAGAKU K. K.) | 4 |
| Ispropyl alcohol | 96 |

The coating liquid 12 was coated on a front surface of the image recording sheet substrate by using a bar coating method and dried to form an intermediate layer having a dry solid amount of 1.0 g/m$^2$.

A coating liquid for an image receiving layer (D) was prepared in the composition 13 shown below.

Composition 13 (Image receiving layer (D))

| Components | Parts by mass |
|---|---|
| Polyester resin (trademark: Vylon 200, made by TOYOBO K. K.) | 100 |
| Silicone oil (trademark: KF 393, made by SHINETSU KAGAKUKOGYO K. K.) | 3 |
| Isocyanate (trademark: TAKENATE D-120N, made by TAKEDA YAKUHIN K. K.) | 6 |
| Hindered amine photostabilizer (trademark: ADECASTAB LA-63, made by ASAHI DENKA K. K.) | 4 |
| Toluene/methylethylketone (1:1 by mass) mixture | 300 |

The coating liquid 13 was coated on the intermediate layer by a gravure coating method and dried, to form an image receiving layer (D) having a dry solid amount of 7 g/m$^2$.

(2) Adhesive Layer

A coating liquid for an adhesive layer was prepared in the composition 14 shown below.

Composition 14 (Adhesive layer)

| Components | Parts by mass |
|---|---|
| Acrylic adhesive agent (trademark: AT-191, made by SAIDEN KAGAKU K. K.) | 100 |
| Curing agent (trademark: AL, made by SAIDEN KAGAKU K. K.) | 1 |
| Foamed composite hollow particles (trademark: MATSUMOTO MICRO SPHERE MFL-80GCA, made by MATSUMOTO YUSHI K. K.) having an average particle size of 3.6 μm and a percentage of hollow of 88% | 0.25 |

The coating liquid 14 was coated on a back surface of the image recording sheet substrate (C) by a gravure coating method and dried at 100° C., to form an adhesive layer in a dry solid amount of 16 g/m$^2$.

(3) Release Sheet Section and Lamination

As a substrate (A) for a release sheet section (1), a biaxially oriented porous polyetylene terephthalate film containing an inorganic pigment and having a thickness of 100 μm (trademark: W900 E100, made by MITSUBISHI POLYESTER FILM K.K.) was employed.

A front surface of the release sheet substrate (A) was coated with a silicone release agent (trademark:

KS830, made by SHINETSU KAGAKUKOGYO K.K.) by a gravure coating method and dried to form a release layer (B) having a dry solid amount of 0.6 g/m$^2$.

A liquid coating liquid for a backing resin layer (F) was prepared as the composition 15 shown below.

Composition 15 (Backing resin layer (F))

| Components | Parts by mass |
|---|---|
| Polyvinyl acetal resin (trademark: ESLEC BX-1, made by SEKISUI KAGAKU K. K.) | 6 |
| Cationic electroconductive agent (trademark: ST 2000H, made by MITSUBISHI YUKA K. K.) | 2 |
| Barium stearate (made by NITTO KAGAKUKOGYO K. K.) | 7 |
| Isopropyl alcohol/methylethylketone (8/2 by mass) mixture | 100 |

The back surface of the release sheet substrate (A) was coated with the coating liquid 15 by a bar coating method and dried to form a backing resin layer (F) in a dry solid amount of 2.8 g/m$^2$.

The resultant release sheet section (1) was laminated on the image recording sheet section (2) in such a manner that the release layer (A) surface of the release sheet section (1) is brought into contact with the adhesive layer (E) surface of the image recording sheet section (2), to provide a thermal transfer image recording composite sheet.

Example 11

A thermal transfer image recording composite sheet was produced by the same procedures as in Example 10, except that, in the coating liquid 14 for the adhesive layer (E), the foamed composite hollow particles (trademark: MATSUMOTO MICROSPHERE MFL-80GCA) were employed in an amount of 2 parts by mass.

Example 12

A thermal transfer image recording composite sheet was produced by the same procedures as in Example 10, except that in the coating liquid 14 for the adhesive layer (E), the foamed composite hollow particles (trademark: MATSUMOTO MICROSPHERE MFL-80GCA) were employed in an amount of 0.5 parts by mass, and the adhesive layer (E) was formed in a dry solid amount of 6 g/m$^2$.

Example 13

A thermal transfer image recording composite sheet was produced by the same procedures as in Example 10, except that in the coating liquid 14 for the adhesive layer (E), the foamed composite hollow particles (trademark: MATSUMOTO MICROSPHERE MFL-80GCA) were employed in an amount of 0.5 parts by mass, and the adhesive layer (E) was formed in a dry solid amount of 27 g/m$^2$.

Example 14

A thermal transfer image recording composite sheet was produced by the same procedures as in Example 6, except that as an image recording sheet substrate (C), an oriented porous polypropylene film containing an inorganic pigment and having a thickness of 95 μm (trademark: YUPO FPG 95, made by YUPO CORP.) was employed and, as a release sheet substrate (A), a biaxially oriented non-porous polyethylene terephthalate film having a thickness of 50 μm (trademark: TETRON U2, made by TEIJIN) was employed.

Comparative Example 4

A thermal transfer image recording composite sheet was produced by the same procedures as in Example 6, except that in the coating liquid 6 for the adhesive layer (E), the foamed composite hollow particles (trademark: MATSUMOTO MICROSPHERE MFL-80GCA) were replaced by other foamed composite hollow particles having an average particle size of 40 μm and a specific gravity of 30 kg/m$^3$ (trademark: EXPANCELL 091DE, made by NIHON FERITE K.K.).

Comparative Example 5

A thermal transfer image recording composite sheet was produced by the same procedures as in Example 8, except that, in the coating liquid 10 for the adhesive layer (E), the microcapsule type hollow particles (trademark: LOPAQUE OP-84J) were replaced by another microcapsule type hollow particles having an average particle size of 0.25 μm (trademark: BONCOAT PP-199, made by DAINIPPON INK).

Comparative Example 6

A thermal transfer image recording composite sheet was produced by the same procedures as in Example 10, except that, in the coating liquid 14 for the adhesive layer (E), the foamed composite hollow particles (trademark: MATSUMOTO MICROSPHERE MFL-80GCA) were omitted.

Comparative Example 7

A thermal transfer image recording composite sheet was produced by the same procedures as in Example 6, except that, as an image recording sheet substrate (C), a biaxially oriented porous polyethylene terephthalate film containing an inorganic pigment and having a thickness of 38 μm (trademark: W900 J38, made by MITSUBISHI KAGAKU POLYESTER FILM K.K.) was employed and, as a release sheet abstrate (A), a biaxially oriented non-porous white-colored polyethylene terephthalate film having a thickness of 125 μm (trademark: TETRON U2, made by TEIJIN) was employed.

Comparative Example 8

A thermal transfer image recording composite sheet was produced by the same procedures as in Example 6, except that, as an image recording sheet substrate (C), a biaxially oriented non-porous white-colored polyethylene terephthalate film having a thickness of 100 μm (trademark: TETRON U2, made by TEIJIN) was employed, and as a release sheet abstrate (A), a biaxially oriented non-porous white colored polyethylene terephthalate film having a thickness of 38 μm (trademark: TETRON U2, made by TEIJIN) was employed.

Samples of the image recording composite sheet of Examples 6-14 and Comparative Examples 4 to 8 were subjected to the following tests and evaluations.

(1) Compressive Modulus

The compressive modulus of each sample was measured in accordance with JIS K 7220. In the measurement, the height of the test piece was represented by a thickness of the sample and the compression was carried out at a compression rate of 20 μm/minute.

(2) Resistance to Denting of Image Recording Sheet

A thermal transfer video printer (trademark: M1, made by SONY) was modified to a tester having sheet-conveying nip rolls working under a high nipping treasure. The nipping pressure of the tester was 200 kg/cm$^2$, determined by using pressure testing films (trademark: Prescale, made by FUJI PHOTOGRAPHIC FILM K.K.).

The dent resistance of the samples of the image recording sheets measured by the tester was evaluated by naked eye-observation, into the following three classes.

| Class | Resistance to denting |
|---|---|
| 3 | No denting is found |
| 2 | Slight denting are formed |
| 1 | Significant denting are found |

(3) Resistance to Transfer of Ink Ribbon Wrinkles

An image receiving surface of the sample was brought into contact successively with each of yellow, magenta and cyan ink layers of an ink ribbon, each coated on a surface of a polyester film having a thickness of 6 μm and containing a sublimating dye and a binder, in a thermal transfer video printer (trademark: DPP-SV55, made by SONY), to print a solid black image. The printing operation was continuously carried out to print 50 sheets. The wrinkle marks transferred from the ink sheets onto the image receiving layer surface were checked by the naked eye and evaluated in the following three classes

| Class | Resistance to wrinkle marks |
|---|---|
| 3 | No wrinkle marks found on image receiving layer surface |
| 2 | Wrinkle marks are found on only one sheet. Practically usable. |
| 1 | Wrinkle marks are found two or more sheets. Not practically usable. |

(4) Quality of Recorded Images (Color Density, Uniformity of Images)

An ink ribbon was prepared by coating a surface of a polyester film having a thickness of 6 μm with three coloring ink layers each containing a yellow, magenta or cyan-coloring sublimating dye and a binder, and arranged repeatedly on the film.

The sample was subjected to a printing by using a thermal transfer video printer (trademark: DPP-SV55, made by SONY), in such a manner that the three-color ink sheets were successively brought into contact with an ink receiving layer surface of the sample, while heating imagewise the ink sheets with a thermal head heating energy of which are controlled stepwise, to thermally transfer recording simple color images or integrated color images on the ink recording sheet surface, the recorded images on the sample were subjected to a measurement of color density of the images at every energy applied for printing, using a MacBeth color density meter (trademark: RD-914, made by KOLL-MORGEN CO.). The color density of the images-was represented by a value at a high color density gradation at which the color density valve is highest.

Also, the uniformity of the images at a gradation at which the reflected color density (of black color images) corresponds to 0.3, was evaluated by checking the uniformity of color density and the defect of images.

The quality of the recorded images was evaluated in the following three classes.

| Class | image quality |
|---|---|
| 3 | Excellent |
| 2 | Good |
| 1 | Significantly defective |

(5) Resistance to Bulging of Adhesive Agent

The sample was wound up, and then cut, while unwinding the sample, into a sheet piece, by using a cutter. During the above-mentioned procedure, the processability of the sample was checked by the naked eye and evaluated in the following three classes.

| Class | Bulging resistance |
|---|---|
| 3 | Substantially no bulging of adhesive agent is formed. |
| 2 | Slight bulging of adhesive agent is found, usable in practical use. |
| 1 | Significant bulging of adhesive agent is found. Processability is poor. |

(6) Separating Property

The samples was subjected to a separation test in which the image recording sheet section was separated by hand from the release sheet section, and a resistance of the image recording sheet section to a wrinkling phenomenon on the image receiving layer surface was evaluated by naked eye observation in the following three classes.

| Class | Evaluation |
|---|---|
| 3 | No wrinkles are generated. |
| 2 | Slight wrinkles are generated. Usable in practice |

-continued

| Class | Evaluation |
|---|---|
| 1 | Significant wrinkle are generated and appearance was bad. |

The test results are shown in Table 2.

TABLE 2

| Example No. | | Item | | | | | | |
|---|---|---|---|---|---|---|---|---|
| | | Compressive modulus (MPa) | Resistance to denting of recording sheet | Resistance to transfer of wrinkles from ink ribbon | Color density (black images) | Uniformity of images | Resistance to bulging of adhesive agent | Separating property |
| Example | 6 | 33 | ○ | ○ | 2.11 | ○ | ○ | ○ |
| | 7 | 31 | ○ | ○ | 2.13 | ○ | ○ | ○ |
| | 8 | 45 | ○ | ○ | 2.05 | ○ | ○ | ○ |
| | 9 | 43 | ○ | ○ | 2.09 | Δ | ○ | ○ |
| | 10 | 42 | ○ | ○ | 2.09 | ○ | ○ | ○ |
| | 11 | 16 | ○ | ○ | 2.15 | ○ | ○ | ○ |
| | 12 | 45 | ○ | ○ | 2.05 | ○ | ○ | ○ |
| | 13 | 40 | ○ | ○ | 2.12 | ○ | Δ | ○ |
| | 14 | 36 | ○ | ○ | 2.10 | ○ | ○ | ○ |
| Comparative Example | 4 | 27 | ○ | ○ | 2.12 | x | ○ | ○ |
| | 5 | 55 | x | x | 1.93 | ○ | ○ | ○ |
| | 6 | 65 | x | x | 1.94 | Δ | ○ | ○ |
| | 7 | 34 | ○ | ○ | 2.12 | ○ | ○ | x |
| | 8 | 52 | x | x | 1.82 | ○ | ○ | ○ |

As shown in Tables 1 and 2, when the image recording composite sheet is printed by using a thermal transfer printer, the image recording sheets exhibit high resistances to roughening by the thermal head and to denting by a high nipping pressure of the sheet-conveying nip rolls, and can be record with images having a high color density and clarity. In the image recording composite sheets of the present invention, the image recording sheet section (2) can be separated, after image recording, from the release sheet section (1) and then adhered to a desired article.

The thermal transfer image recording composite sheet of the present invention is advantageously useful in industrial practice.

The invention claimed is:

1. A thermal transfer image recording composite sheet comprising (1) a release sheet section comprising (A) a substrate sheet for the release sheet section (1) and (B) a release layer formed on a surface of the substrate sheet (A) and comprising a release agent: and (2) an image recording sheet section comprising (C) a substrate sheet for the image recording sheet section (2), (D) an image receiving layer formed on a surface of the substrate sheet (C) and comprising a dyeable resin, and (E) an adhesive layer formed on an surface of the substrate sheet (C) other than the surface on which the image receiving layer is formed, comprising an adhesive agent and separably adhered to the release layer (B) of the release sheet section (1), wherein:

the substrate sheet (C) for the image recording sheet section (2) comprises (a) an upper oriented porous polyester film layer bonded to the image receiving layer (D) and (b) a lower oriented porous polymer film layer the polymer of which is different from the polyester for the upper oriented porous polyester film layer (a) and which is bonded, on a surface thereof, to the adhesive layer (E), and, on an other surface thereof, to the upper oriented porous polyester film layer (a), the oriented porous polyester film for the upper polyester film layer (a) is one produced by forming an undrawn film from a mixture comprising a matrix polyester resin and at least one member selected from a particulate resin and a filler each incompatible with the matrix polyester resin; and drawing the undrawn film in at least one direction, to cause the oriented polyester film to be porous, and has a compressive modulus of 10 to 80 Mpa, determined in accordance with Japanese Industrial Standard K 7220, and the recording sheet has, as a whole, a compressive modulus of 50 Mpa or less, determined in accordance with Japanese Industrial Standard K 7220.

2. The thermal transfer image recording composite sheet as claimed in claim 1, wherein the image receiving layer (D) exhibits a Hunter brightness of 80% or more, determined in accordance with JIS P 8123 and a Hunter opacity of 90% or more, determined in accordance with JIS P 8138.

3. The thermal transfer image recording composite sheet as claimed in claim 1, wherein the upper oriented porous polyester film layer (a) in the substrate sheet (C) for the image recording sheet section (2) exhibits a Hunter brightness of 80% or more determined in accordance with JIS P 8123 and a Hunter opacity of 90% or more, determined in accordance with JIS P 8138.

4. The thermal transfer image recording composite sheet as claimed in claim 1, wherein the lower oriented porous polymer film layer (b) bonded to the adhesive layer (E) has a lower compressive modulus than that of the upper oriented porous polyester film layer (a) bonded to the image receiving layer (D).

5. The thermal transfer image recording composite sheet as claimed in claim 4, wherein the oriented porous polymer film for the lower polymer film layer (b) has a compressive modulus of 45 MPa or less.

6. The thermal transfer image recording composite sheet as claimed in claim 1, wherein the oriented porous polymer film for the lower polymer film layer (b) comprises at least one member selected from polyolefin, nylon, polyurethane and polybutadiene resins.

7. The thermal transfer image recording composite sheet as claimed in claim 1, wherein the oriented porous polymer film for the lower polymer film layer (b) is one prepared by forming an undrawn film from a mixture comprising a matrix polymer different from polyester for the upper polyester film layer (a) and at least one member selected from a particulate resin and a pigment each incompatible with the matrix polymer: and drawing the undrawn film in at least one direction to cause the oriented polymer film to be porous.

8. The thermal transfer image recording composite sheet as claimed in claim 1, wherein the adhesive layer (E) comprises, in addition to the adhesive agent, a plurality of hollow particles each constituted from a core hollow portion and a shell portion comprising a polymeric material and surrounding and closing the core hollow portion, the hollow particles having an average particle size of 0.3 to 30 μm.

9. The thermal transfer image recording composite sheet as claimed in claim 8, wherein, in the adhesive layer (E), the hollow particles are present in an amount of 0.1 to 2.5% by mass based on the dry solid mass of the adhesive layer (E).

10. The thermal transfer image recording composite sheet as claimed in claim 8, wherein a ratio ($TH_C/TH_A$) of the thickness $TH_C$ of the substrate sheet (C) of the image recording sheet section (2) to the thickness $TH_A$ of the substrate sheet (A) of the release sheet section (1) is in the range of from 0.35 to 2.5.

11. The thermal transfer image recording composite sheet as claimed in claim 8, wherein the adhesive layer (E) is present in an amount, by dry solid mass, of 5 to 30 g/m$^2$.

12. The thermal transfer image recording composite sheet as claimed in claim 8, wherein the hollow particles for the adhesive layer (E) are selected from the group consisting of (i) foamed hollow particles produced by heat-foaming particles comprising a thermoplastic polymer material and a thermal expansion substance mixed into the thermoplastic polymer material; and (ii) microcapsules produced by forming precursor microcaplules each comprising a core portions consisting of a volatile liquid and a shell portion comprising a thermoplastic polymer material and surrounding the core portion by a microcapsule-polymerization method, and evaporating away the volatile liquid from the precursor microcapsules, to form microcapsules each having a hollow core surrounded and closed by a shell.

13. The thermal transfer image recording composite sheet as claimed in claim 1, wherein the dyeable resin contained in the image receiving layer (D) is dyeable with sublimating dyes.

* * * * *